US006371383B1

(12) United States Patent
Bulgatz

(10) Patent No.: US 6,371,383 B1
(45) Date of Patent: Apr. 16, 2002

(54) WELD JOINT DESIGN FOR AN ARMATURE/ BALL ASSEMBLY FOR A FUEL INJECTOR

(75) Inventor: Dennis Bulgatz, Williamsburg, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/655,045

(22) Filed: Sep. 5, 2000

(51) Int. Cl.[7] ..... B05B 17/00; B05B 1/30; F02M 51/00

(52) U.S. Cl. ..... 239/1; 239/585.1; 239/585.2; 239/585.3; 239/585.4; 239/585.5; 29/890.124

(58) Field of Search ..... 239/585.1, 585.2, 239/585.3, 585.4, 585.5, 900, 1, 5; 29/890.124

(56) References Cited

U.S. PATENT DOCUMENTS 4,564,145 A * 1/1986 Takada et al. ..... 239/585.1
4,875,658 A * 10/1989 Asai ..... 239/585.1
5,178,362 A * 1/1993 Vogt et al. ..... 239/585.1
5,222,673 A * 6/1993 Reiter ..... 239/585.1
5,360,166 A * 11/1994 Nogi et al. ..... 239/585.1
5,566,920 A * 10/1996 Romann et al. ..... 239/585.4 X
6,079,642 A * 6/2000 Maier ..... 239/585.1

* cited by examiner

*Primary Examiner*—Robin O. Evans

(57) ABSTRACT

A fuel injector is provided. The fuel injector includes a metering member for delivering fuel from a delivery end of the fuel injector. The metering member comprises a seat disposed proximate the delivery end of the fuel injector; and an armature assembly. The armature assembly includes a longitudinal axis, a seating element disposed generally along the longitudinal axis, and an elongated tube. The elongated tube has a first end, a second end, and a tube channel extending from the second end toward the first end. The first end has a first portion connected to the seating element with at least one weld and a second portion disposed distal from the longitudinal axis from the first portion. The armature assembly is reciprocably disposed within the fuel injector between a closed position wherein the seating element is biased against the seat and an open position wherein the seating element is disposed away from the seat. A method of manufacturing the armature assembly is also provided.

26 Claims, 2 Drawing Sheets

WELD JOINT DESIGN FOR AN ARMATURE/ BALL ASSEMBLY FOR A FUEL INJECTOR

FIELD OF THE INVENTION

The present invention relates to a weld design to fix a ball to a tube to form an armature assembly for a fuel injector.

BACKGROUND OF THE INVENTION

In known applications, steel balls are welded to tubes in a fuel injector armature assembly such that the weld joint typically is made at the end of the tube, forming a butt type weld. The ball is typically constructed from high chromium and high carbon steel alloy, such as 44° C., and is difficult to weld to the armature. The excess carbon in 44°C. (1 percent) exceeds the solubility limit of carbon in iron, which forces carbides to form during alloy manufacture. During the welding process, rapid cooling often leads to cracked welds. Further, adding excess heat during the welding can distort the ball roundness, which leads to improper ball seating in the seat during operation of the injector.

It would be beneficial to provide an armature/ball assembly which can be manufactured without introducing excess heat during the welding process, and in which a sufficiently strong connection can be formed between the tube and the ball.

BRIEF DESCRIPTION OF THE PREFERRED EMBODIMENTS

Briefly, a fuel injector is provided. The fuel injector comprises a metering member for delivering fuel from a delivery end of the fuel injector. The metering member comprises a seat disposed proximate the delivery end of the fuel injector; and an armature assembly. The armature assembly includes a longitudinal axis, a seating element disposed generally along the longitudinal axis, and an elongated tube. The elongated tube has a first end, a second end, and a tube channel extending from the second end toward the first end. The first end has a first portion connected to the seating element with at least one weld and a second portion disposed distal from the longitudinal axis from the first portion. The armature assembly is reciprocably disposed within the fuel injector between a closed position wherein the seating element is biased against the seat and an open position wherein the seating element is disposed away from the seat.

Additionally, the present invention provides an armature assembly. The armature assembly comprises a longitudinal axis, a seating element disposed generally along the longitudinal axis, and an elongated tube. The elongated tube has a first end, a second end, and a tube channel extending from the second end toward the first end. The first end has a first portion connected to the seating element with at least one weld and a second portion disposed distal from the longitudinal axis from the first portion. The armature assembly is reciprocably disposed within the fuel injector between a closed position wherein the seating element is biased against the seat and an open position wherein the seating element is disposed away from the seat.

Also, the present invention provides a method of manufacturing an armature assembly. The method comprises providing an elongated tube having a longitudinal axis extending therethrough, a first end having a first portion and a second portion located distal from the longitudinal axis relative to the first portion, a second end, a tube channel extending from the second end toward the first end; and fixedly connecting a seating element to the first portion with a connection.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the futures of the invention. In the drawings.

DETAILED DESCRIPTION OF THE PREFERRED EMBODIMENTS

Figure 1:
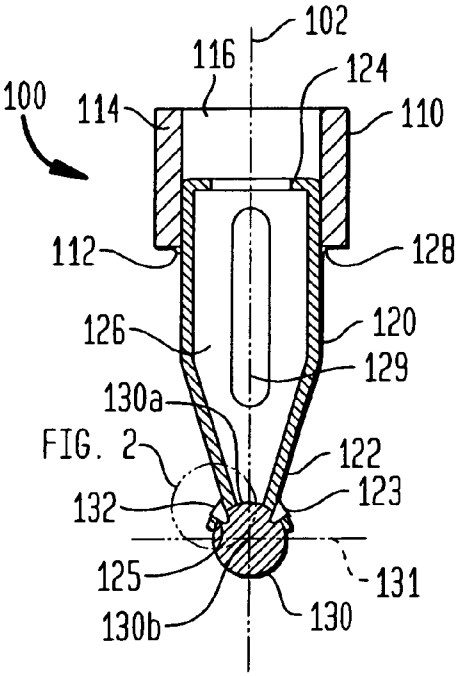
FIG. 1 is a sectional view of a first preferred embodiment of the present invention.
Figure 3:
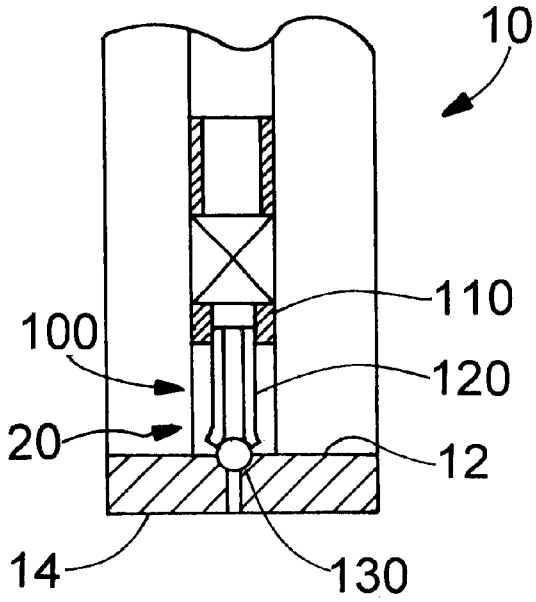
FIG. 3 is a partial sectional view of a fuel injector in which the first preferred embodiment of the present invention is installed.

A first embodiment of an armature/ball assembly 100 for a fuel injector according to the present invention is shown in FIG. 1. Although the assembly 100 is preferably used to precisely meter fuel flow in a fuel injector 10, shown in FIG. 3, those skilled in the art will recognize that the assembly 100 according to the present invention can be used in other applications in which precise metering of a fluid is desired or required. The assembly 100, together with a seat 12, located at a delivery end 14 of the fuel injector 10, form a metering member 20 which provides a desired amount of fuel from the delivery end 14 of the fuel injector 10.

The armature ball assembly 100 includes a magnetic armature 110, a generally elongated tube 120, and a seating element in the form of a generally spherical steel ball 130. A longitudinal axis 102 extends the length of the assembly 100.

The armature 110 includes a first end 112, a second end 114, and a longitudinal armature channel 116, which extends between the first end 112 and the second end 114, generally along the longitudinal axis 102. Preferably, the armature 110 is constructed from a magnetic grade chromium steel, although those skilled in the art will recognize that the armature 110 can be constructed from other magnetic materials as well.

The generally elongated tube 120 includes a first end 122, a second end 124, and a longitudinal tube channel 126 which extends from the second end 124 toward the first end 122, generally along the longitudinal axis 102 such that the tube channel 126 is in communication with the armature channel 116. Preferably, the tube 120 is constructed from a non-magnetic stainless steel, although those skilled in the art will recognize that the tube 120 can be constructed from other, suitable materials as well.

The first end 122 of the tube 120 is generally conical in shape, with the tube 120 tapering inward toward the longitudinal axis 102. Preferably, the tip 123 of the first end 122 extends generally away from the longitudinal axis 102, forming a tube seat 125 for the seating element 130. The tip 123 of the first 122 includes a first portion 123*a* and a second portion 123*b*. As seen in enlarged FIG. 2, the second portion 123*b* is disposed farther from the longitudinal axis 102 than the first portion 123*a*.

The second end 124 of the tube 120 is inserted into the armature channel 116 from the first end 112 of the armature 110. The armature 110 is then fixedly connected to the tube 120 with a weld 128, preferably a laser weld, although those skilled in the art will recognize that the armature 110 and the tube 120 can be connected by brazing, swaging, gluing, crimping, or by other known methods of connection.

Figure 2:
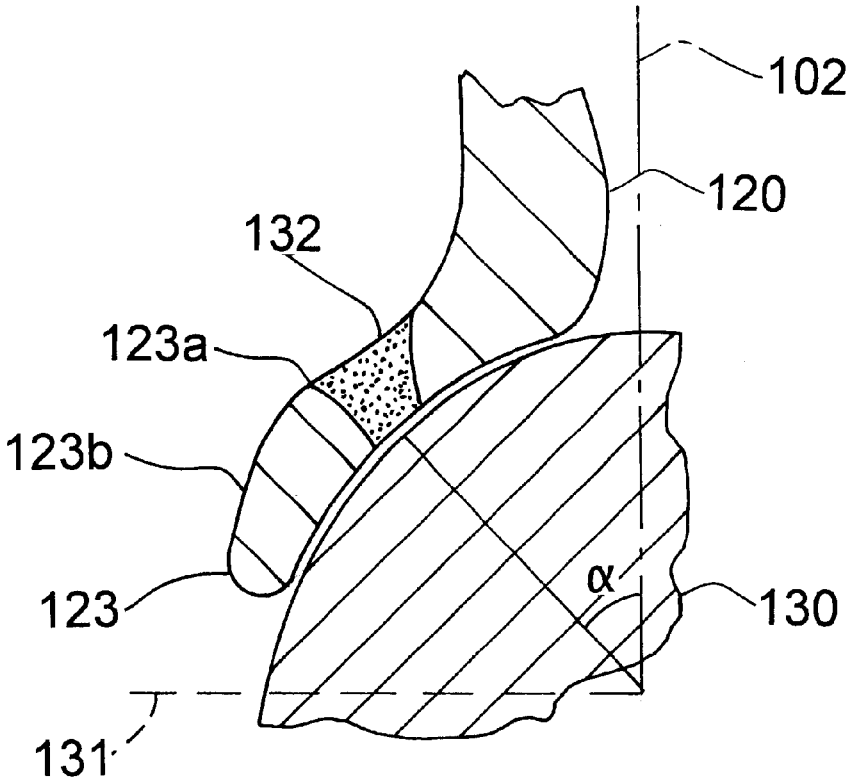
FIG. 2 is an enlarged view of a connection between an armature-tube and sealing element of the first embodiment.

Preferably, the seating element 130 is constructed of a chromium and carbon steel alloy, although those skilled in the art will recognize that the seating element 130 can be constructed from other materials as well. The seating element 130 is generally centered on the longitudinal axis 102 and is located in the tube seat 125 formed by the tip 123 of the first end 122 of the tube 120. The seating element 130 includes a central plane 131, which divides the seating element 130 into upper and lower halves 130*a*, 130*b*, respectively. The seating element 130 is fixedly connected to the first end 122 of the tube 120, preferably with at least one weld 132 in the upper half 130*a* of the seating element 130, preferably in the first portion 123*a*. Preferably, the weld 132 is applied through the first portion 123*a* to the seating element 130, forming a lap weld, as is shown in FIGS. 1 and 2. The lap weld eliminates the potential for oxidizing any oxygen which may be present around the weld, yielding a stronger bond between the tube 120 and the seating element 130.

The second portion 123*b* is preferably weld-free. The lap weld does not require the first end 122 of the tube 120 to be precisely cut. The first end 122 of the tube 120 can be formed to match the shape of the seating element 130 to provide a precise fit. By welding through the tube 120 to the seating element 130, the seating element 130 is heated and cooled relatively slowly, reducing thermal gradients in the seating element 130, resulting in a reduction of shape distortion, which provides a better sealing of a portion of the lower half 130*b* of the seating element 130 with the seat 12 during operation of the fuel injector 10. As seen in FIG. 2, the weld 132 is located at an angle $\alpha$ of approximately forty-five degrees around an outer perimeter of the sealing element 130. The tube 120 can have at least one opening 129 between the armature 110 and the seating element 130 to allow fuel or other fluid to flow through the armature channel 106, through the tube channel 116 and through the opening for discharge from the injector. Preferably, the at least one opening 129 is as large as possible, both to reduce weight of the tube 120 and to break up vapor bubbles which may form around the tube 120. As shown in FIG. 1, the opening 129 is preferably non-circular to aid in bubble break-up.

To manufacture the assembly 100, the tube 120 is initially provided. The tube 120 may be generally conically shaped, tapering inward from the second end 124 toward the first end 122. The tip 123 of the first end 122 is bent generally away from the longitudinal axis 102, forming the tube seat 125. The seating element 130 is then axially compressed against the first end 122 of the tube 120 and into the tube seat 125, so that the seating element 130 is generally self-centered on the longitudinal axis 102. The first portion 123*a* of the tip 123 is then connected to the upper half 130*a* of the seating element 130 from the exterior of the tube 120 through the tip 123 with the weld 132, as shown in FIG. 2, preferably with a lap weld using a YAG pulse, or a continuous wave laser. However, those skilled in the art will recognize that other types of lasers can be used. Preferably, the weld 132 is disposed relatively far from the central plane 131 so that the welding process minimally distorts the lower half 130*b* of the seating element 130.

After the seating element 130 is welded to the tube 120, the second end 124 of the tube 120 can be bent toward the longitudinal axis 102 to facilitate insertion of the second end 124 into the armature channel 116. The second end 124 of the tube 120 is then fixedly connected to the armature 110 so that the armature channel 116 communicates with the tube channel 126. The assembly 100 is now prepared for installation into the fuel injector 10.

The assembly 100 is installed in the fuel injector 10 to be reciprocably disposed within the fuel injector 10 between a closed position (shown in FIG. 3) wherein the seating element 130 is biased against the seat 12 and an open position (not shown) wherein the seating element 130 is disposed away from the seat 12.

Figure 5:
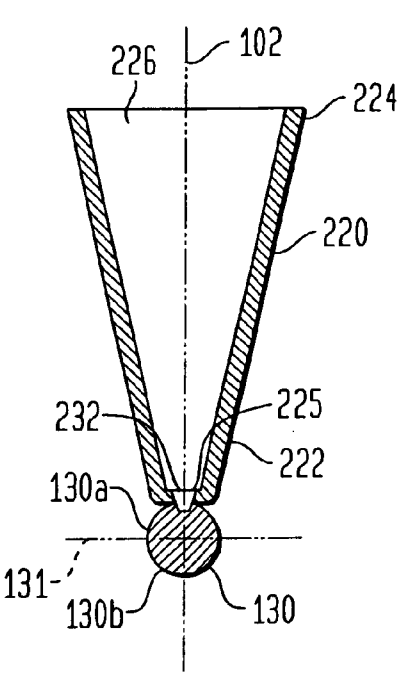
FIG. 5 is a sectional view of the second preferred embodiment during manufacture.
Figure 4:
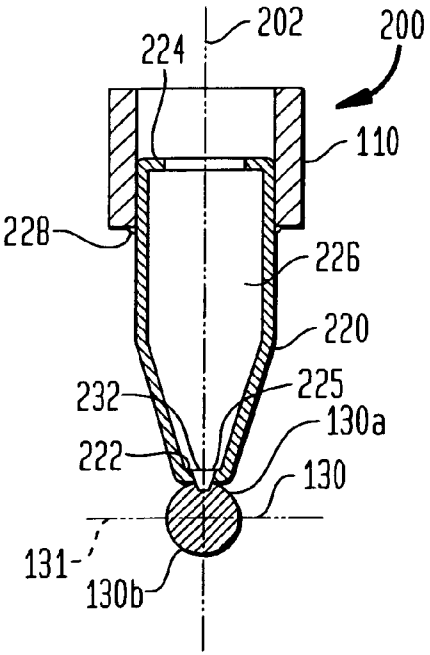
FIG. 4 is a sectional view of a second preferred embodiment of the present invention.

A second embodiment of the assembly 200 is shown in FIGS. 4 and 5. The assembly 200 is similar to the assembly 100 shown in FIG. 1, with the exception of a modified tube 220. The first end 222 of the tube 220 is closed and forms a generally concave seat 225 as viewed from the exterior of the tube 220. A tube channel 226 extends from a second end 224 toward, but not through, the first end 222.

The tube 220 is fixedly connected to the seating element 130 with at least one weld 232, which extends generally along the longitudinal axis 102 through the first end 222 to the seating element 130.

To manufacture the assembly 200, the tube 220 is initially provided. The tube 220 may be generally conically shaped, tapering inward from the second end 224 toward the first end 222. The seating element 130 is then axially compressed against the first end 222 of the tube 220 and into the concave seat 225, so that the seating element 130 is generally self-centered on the longitudinal axis 102.

The seating element 130 is then fixedly connected to the first end 222 of the tube 220 by welding through the first end 222 of the tube 220 to the seating element 130, generally along the longitudinal axis 202. The welding is accomplished by forming the weld 232 through the tube channel 226, as shown in FIG. 4. The tube 220 is then bent from the shape shown in FIG. 5 to the final shape shown in FIG. 4. The initial shape of the tube 220 allows a welding machine, such as a laser, to enter the tube channel 226 to make the weld 232. After the tube 220 is bent, the second end 224 of the tube 220 is then fixedly connected to the armature 110 with a weld 228 so that the armature channel 116 communicates with the tube channel 226. The assembly 200 is now prepared for installation into the fuel injector 10.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined in the appended claims.

What is claimed is:

1. A fuel injector comprising a metering member for delivering fuel from a delivery end of the fuel injector, the metering member comprising:

a seat disposed proximate the delivery end of the fuel injector; and an armature assembly including:

a longitudinal axis;

a seating element disposed generally along the longitudinal axis; and an elongated tube having a first end, a second end, and a tube channel extending from the second end toward the first end, the first end having a first portion with an outer surface and an inner surface, the inner surface being coupled to the seating element with at least one weld extending through the inner and outer surfaces of the first portion so as to engage the seating element with a contact surface, the at least one weld including an exposed surface distal to the contact surface, the exposed surface being contiguous to the outer surface of the first portion, and a generally weld-free second portion disposed distal from the longitudinal axis and from the first portion.

2. The fuel injector according to claim 1, wherein the seating element is generally spherical.

3. The fuel injector according to claim 2, wherein the at least one weld is located approximately forty-five degrees around an outer perimeter of the sealing element from the longitudinal axis.

4. The fuel injector according to claim 1, wherein the first end extends generally away from the longitudinal axis.

5. The fuel injector according to claim 1, wherein the first end is closed.

6. The fuel injector according to claim 5, wherein the first end is generally concave.

7. The fuel injector according to claim 6, wherein the at least one weld is generally along the longitudinal axis.

8. An armature assembly comprising:

a longitudinal axis;

a seating element disposed generally along the longitudinal axis; and an elongated tube having a first end, a second end, and a tube channel extending from the second end toward the first end, the first end having a first portion with an outer surface and an inner surface, the inner surface being coupled to the seating element with at least one weld extending through the inner and outer surfaces of the first portion so as to engage the seating element with a contact surface, the at least one weld including an exposed surface distal to the contact surface, the exposed surface being contiguous to the outer surface of the first portion, and a generally weld-free second portion disposed distal from the longitudinal axis and from the first portion.

9. The armature assembly according to claim 8, wherein the at least one weld is a lap weld.

10. The armature assembly according to claim 8, her comprising an armature fixedly connected to the second end, the armature having an armature channel extending therethrough in communication with the tube channel.

11. The armature assembly according to claim 8, wherein the first end is generally conical.

12. The armature assembly according to claim 8, wherein the first end is closed.

13. The armature assembly according to claim 12, wherein the first end is generally concave.

14. The armature assembly according to claim 13, wherein the at least one weld is generally along the longitudinal axis.

15. The armature assembly according to claim 8, wherein the seating element comprises a chromium and carbon steel alloy.

16. The armature assembly according to claim 8, wherein the seating element is generally spherical.

17. A method of manufacturing an armature assembly comprising:

providing an elongated tube having a longitudinal axis extending therethrough, a first end having a first portion and a second portion located distal from the longitudinal axis relative to the first portion, the first portion including an outer surface and an inner surface, a second end, and a tube channel extending from the second end toward the first end, the first end extending generally away from the longitudinal axis; and fixedly connecting a seating element to the inner surface of the first portion by welding through the inner and the outer surfaces of the first portion with a weld so as to engage the seating element with a contact surface of the weld, the contact surface being distal to an exposed surface of the weld that is contiguous to the outer surface.

18. The method according to claim 17, wherein the fixedly connecting comprises fixedly connecting the seating element to the first end along the longitudinal axis.

19. The method according to claim 17, further comprising, prior to fixedly connecting, forming a concave surface in the first end and seating the seating element against the concave surface.

20. The method according to claim 17, further comprising connecting an armature to the second end, the armature having an armature channel in communication with the tube channel.

21. The method according to claim 20, further comprising, prior to connecting the armature, bending the second end of the tube and inserting the second end of the tube into the armature channel.

22. The method according to claim 17 wherein the fixedly connecting comprises welding.

23. The method according to claim 22, wherein the welding comprises welding the seating element to the first portion through the tube channel.

24. The method according to claim 23, wherein the first end is closed.

25. The method according to claim 22, wherein the welding comprises lap welding.

26. The method according to claim 19, further comprising, prior to fixedly connecting, axially compressing the seating element against the first end.

* * * * *